US007468716B2

(12) United States Patent
Lee et al.

(10) Patent No.: US 7,468,716 B2
(45) Date of Patent: Dec. 23, 2008

(54) MODIFYING GRAY VOLTAGE SIGNALS IN A DISPLAY DEVICE

(75) Inventors: Seung-Woo Lee, Seoul (KR); Moung-Su Kim, Gyeonggi-do (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 568 days.

(21) Appl. No.: 10/916,260

(22) Filed: Aug. 10, 2004

(65) Prior Publication Data

US 2005/0062703 A1 Mar. 24, 2005

(30) Foreign Application Priority Data

Aug. 11, 2003 (KR) ..... 2003-0055422
Apr. 30, 2004 (KR) ..... 2004-0030426

(51) Int. Cl.
*G09G 3/36* (2006.01)

(52) U.S. Cl. ..... 345/89; 345/690

(58) Field of Classification Search ..... 345/89, 345/690

See application file for complete search history.

(56) References Cited

U.S. PATENT DOCUMENTS 5,465,102 A * 11/1995 Usui et al. ..... 345/89
5,537,128 A * 7/1996 Keene et al. ..... 345/89
6,348,930 B1 * 2/2002 Kobayashi et al. ..... 345/690

* cited by examiner

*Primary Examiner*—Kevin M Nguyen
(74) *Attorney, Agent, or Firm*—MacPherson Kwok Chen & Heid LLP

(57) ABSTRACT

A method and apparatus for driving a display device, as well as a display device incorporating such method and apparatus, are presented. The method includes determining a first difference $\Delta_1$, wherein $\Delta_1$ is a difference between gray signals of two consecutive frames, comparing $\Delta_1$ to a predetermined value to obtain a comparison result, and using the comparison result to determine a modified current gray signal. The modified current gray signal is applied to a current frame to improve image quality. In another aspect, the invention includes a method of driving a display device by determining the gray signal levels for a first frame, a second frame that follows the first frame, and a third frame. A modified current gray signal is determined based on the relative magnitudes of the three gray signal levels, and applied to the current frame.

24 Claims, 11 Drawing Sheets

MODIFYING GRAY VOLTAGE SIGNALS IN A DISPLAY DEVICE

RELATED APPLICATIONS

This application claims priority, under 35 USC § 119, from Korean Patent Application No. 2003-0055422 filed on Aug. 11, 2003 and Korean Patent Application No. 2004-0030426 filed on Apr. 30, 2004, both of which are incorporated by reference herein in its entirety.

FIELD OF INVENTION

The invention relates generally to display devices and particularly to controlling the gray voltage signals in display devices.

BACKGROUND

A liquid crystal display (LCD) includes a pair of panels with field generating electrodes and a liquid crystal layer with dielectric anisotropy disposed between the two panels. An electric field is formed in the liquid crystal layer by using the electrodes, and the desired images are generated by adjusting the electric field to control the light transmittance through the liquid crystal layer. The LCD devices include flat panel display (FPD) devices, which frequently come in the form of TFT-LCDs that use thin film transistors (TFTs) for pixel control.

TFT-LCDs, which were used primarily as computer monitors in the past, are becoming utilized more for entertainment display screens such as television screens. As a result, it has become more important for TFT-LCDs to display quality moving images. However, because TFT-LCDs were traditionally not used to display fast moving images, some improvement is needed for the signal control technology in these devices. Currently, the liquid crystal molecules do not respond to the applied electric field fast enough to display clean fast-moving images. It takes a certain length of time for the liquid crystal capacitor to be charged to a target voltage. When the difference between the target voltage and the previous voltage is large, the liquid crystal capacitor may take a longer than desired length of time to reach the target voltage. A "liquid crystal capacitor" refers to the pair of electrodes that generate the electric field and the liquid crystal layer disposed therebetween.

One of the solutions for the problem of long liquid crystal layer charge time is dynamic capacitance compensation (DCC). The DCC method entails applying a modified voltage, which is higher than a target voltage, to the liquid crystal capacitor to take advantage of fact that the response time decreases as the voltage across the liquid crystal capacitor increases. FIG. 1 is a plot of the luminance level as a function of time in a conventional display device. Time is expressed as the number of frames. Using plots such as the one shown in FIG. 1, the display device determines what modified gray signal to apply to the liquid crystal capacitor. The plot of FIG. 1 illustrates a case where a previous voltage is "0" and the target voltage at frame 1 is "128." According to the plot, a modified gray signal of "208" should be applied to bring the previous voltage of "0" to the target voltage of"128" within one frame. However, the plot also shows that the luminance drops back down by over 10% in the next frame before gradually climbing back up to the desired luminance level. This drop in the luminance level followed by a gradual climb causes "flickering" in the displayed images. The "flickering" phenomenon is especially bad where gray level voltages are low.

When using a computer aided design (CAD) program to draw an object, the program can be operated in a wire frame mode that depicts the object as a wire frame with lines representing a three-dimensional object. When the object is moved across the screen in the wire frame mode or zoomed in or out, some flickering is seen on the screen. This flickering phenomenon, called "wire frame flickering," is particularly severe in a patterned vertically aligned (PVA) mode LCD having cutouts at the field generating electrodes.

FIG. 2 depicts a test screen 20 that is used to check the performance of a liquid display device. As shown, the test screen includes a rectangle 22 (which is usually red) on a gray screen 24. When the rectangle 22 is moved diagonally across the gray screen 24, in the direction indicated by an arrow 25, cyan-colored artifacts 26 briefly appear near two of the corners. The cyan-colored artifacts appear in the regions where the underlying colors have to rapidly change from gray to red and back to gray as the red rectangle is moved. When the rectangle moves, the gray signals for the green and blue pixels in the regions that are touched by the corners during the move have to rapidly switch from 128 to 0, then back to 128. When the gray signal changes from 0 to 128, the DCC-modified signal that is applied is 208. As a result of applying this modified signal, an overshooting of the luminance level occurs as shown in FIG. 3. The luminance levels in the green and blue pixels become higher than what is desired, making the cyan-colored artifacts 26 appear.

The undesirable appearance of cyan-colored artifacts 26 indicates that DCC-based modification does not always provide the desired result. When using DCC, the modified signal is selected based on the assumption that the previous signal has been stabilized. Thus, in cases like above where the "0" signal is sustained only for a brief moment (i.e., one frame) and not stabilized, applying the signal 208 results in overshooting.

The above-described overshooting phenomenon can be explained in reference to the liquid crystal capacitor. FIGS. 4A, 4B, and 4C are plots of liquid crystal capacitance as a function of the gray signal. More specifically, FIG. 4A shows the liquid crystal capacitance ($C_{128}$) when a gray voltage 128 ($V_{128}$) is applied. FIG. 4B shows the liquid crystal capacitance when a gray voltage 0 ($V_0$) is applied when the display device is in the condition illustrated in FIG. 4A. When $V_0$ is applied, the charge in the pixel is $Q_0=C_{128}\times V_0$. The liquid crystal molecules reorient themselves according to $V_0$, which in turn changes the liquid crystal capacitance. As for the TFTs, each TFT turns on for only a fraction of the time designated for one frame, and remains off for the remainder of the frame. When the TFT is turned off, the $Q_0$ should remain constant. Thus, when the liquid crystal capacitance changes, the gray voltage has to be adjusted to maintain a constant $Q_0$. FIG. 4C shows the liquid crystal capacitance at the end of the frame where $V_0$ was applied. At the end of the frame, the liquid crystal capacitance has changed to $C_{G'}$ and the gray voltage has been adjusted to $V_{G'}$, from $V_0$. Applying the modified signal 208 in this state usually means a signal that is unnecessarily high is being applied. Thus, the overshooting creates the cyan-colored artifacts 26.

A method of reducing the liquid crystal response time without causing quality-degrading consequences (such as flickering or overshooting) is desired.

SUMMARY OF THE INVENTION

In one aspect, the invention is a method of driving a display device by determining a first difference $\Delta_1$, wherein $\Delta_1$ is a difference between gray signals of two consecutive frames, comparing $\Delta_1$ to a predetermined value to obtain a comparison result, and using the comparison result to determine a modified current gray signal. The modified current gray signal is applied to a current frame to improve image quality.

In another aspect, the invention is an apparatus for driving a display device. The apparatus includes a signal receiver for producing gray voltages for frames in a predefined format, a frame memory configured to receive the gray voltages, and a gray signal converter. The frame memory stores the gray voltage levels for a plurality of frames. The gray signal converter, which is configured to receive the gray voltages from the frame memory, includes a lookup table, a signal comparator, and a calculator. The lookup table stores modification factors. The signal comparator compares the different gray voltage levels and selects a modification factor from the modification factors stored in the lookup table, and the calculator determines a modified current gray signal to be applied to a current frame by using the selected modification factor.

In yet another aspect, the invention is a display device with improved image quality. The display device includes a display panel having pixels defined by gate lines and data lines and a driving apparatus for providing signals to the gate lines and the data lines. The driving apparatus includes a frame memory, a lookup table, a signal comparator, and a calculator. The frame memory, which is configured to receive gray voltages, stores the gray voltage levels for a plurality of frames. The lookup table, which is coupled to the frame memory, stores modification factors. The signal comparator, which compares the gray voltage from the frame memory and selects a modification factor from the modification factors based on the comparison. The calculator receives the modification factor and determines a modified current gray signal by using the selected modification factor.

The invention includes a method of driving a display device by determining a first gray signal level for a first frame, determining a second gray signal level for a second frame that follows the first frame, determining a third gray signal level for a third frame that follows the second frame, and determining a modified voltage level to apply to the second frame based on relative magnitudes of the first gray signal level, the second gray signal level, and the third gray signal level.

DETAILED DESCRIPTION OF THE PREFERRED EMBODIMENT(S)

The present invention will now be described in more detail with reference to the accompanying drawings, which show the preferred embodiments of the invention. This invention may, however, be embodied in many different forms and should not be construed as being limited to the embodiments set forth herein.

As used herein, a "difference" between two values is an absolute value difference between the two values. "Gray signals" are intended to mean signals incorporating information about gray voltage levels.

Figure 5:
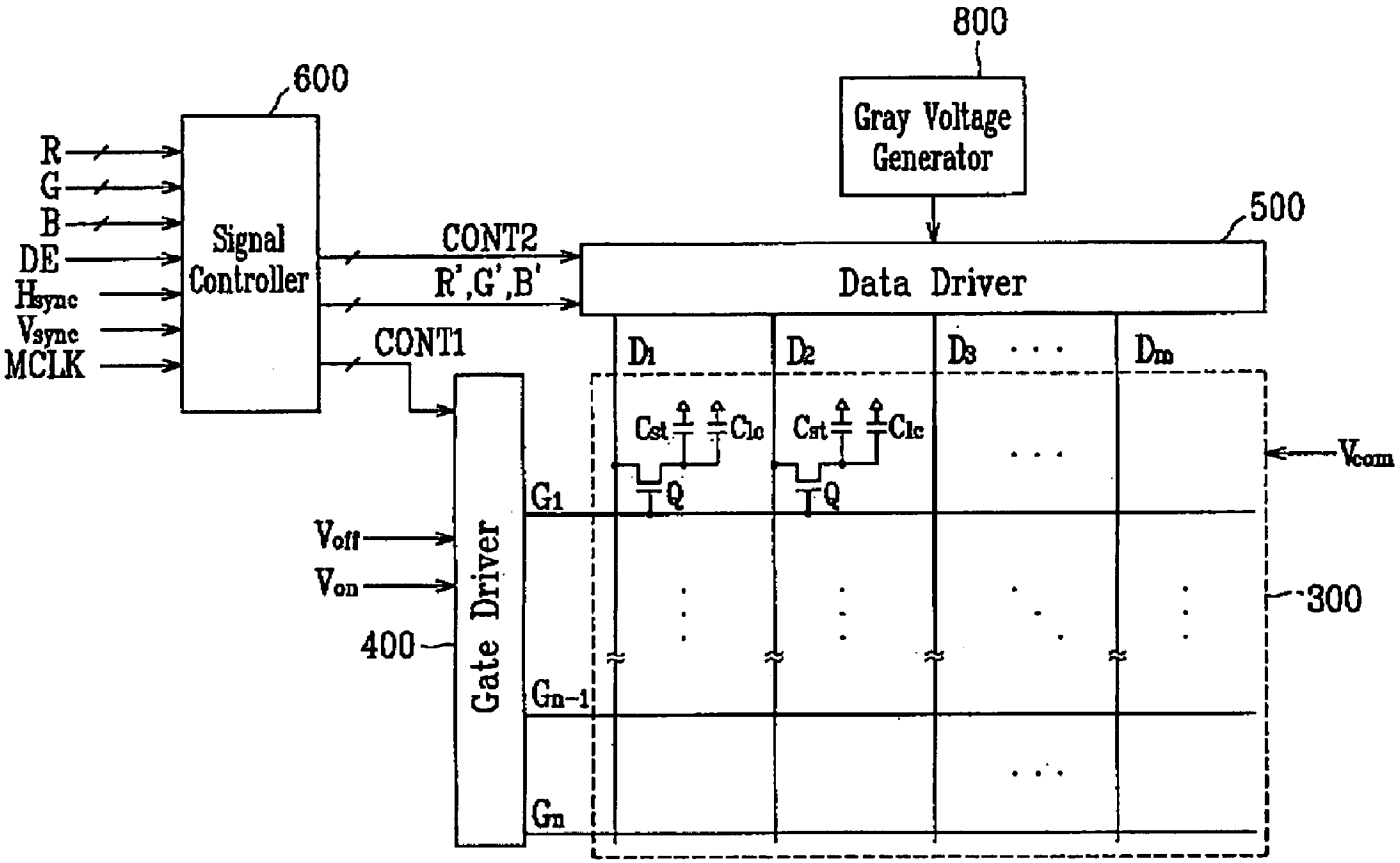
FIG. 5 is a block diagram of an LCD device according to an embodiment of the invention.
Figure 6:
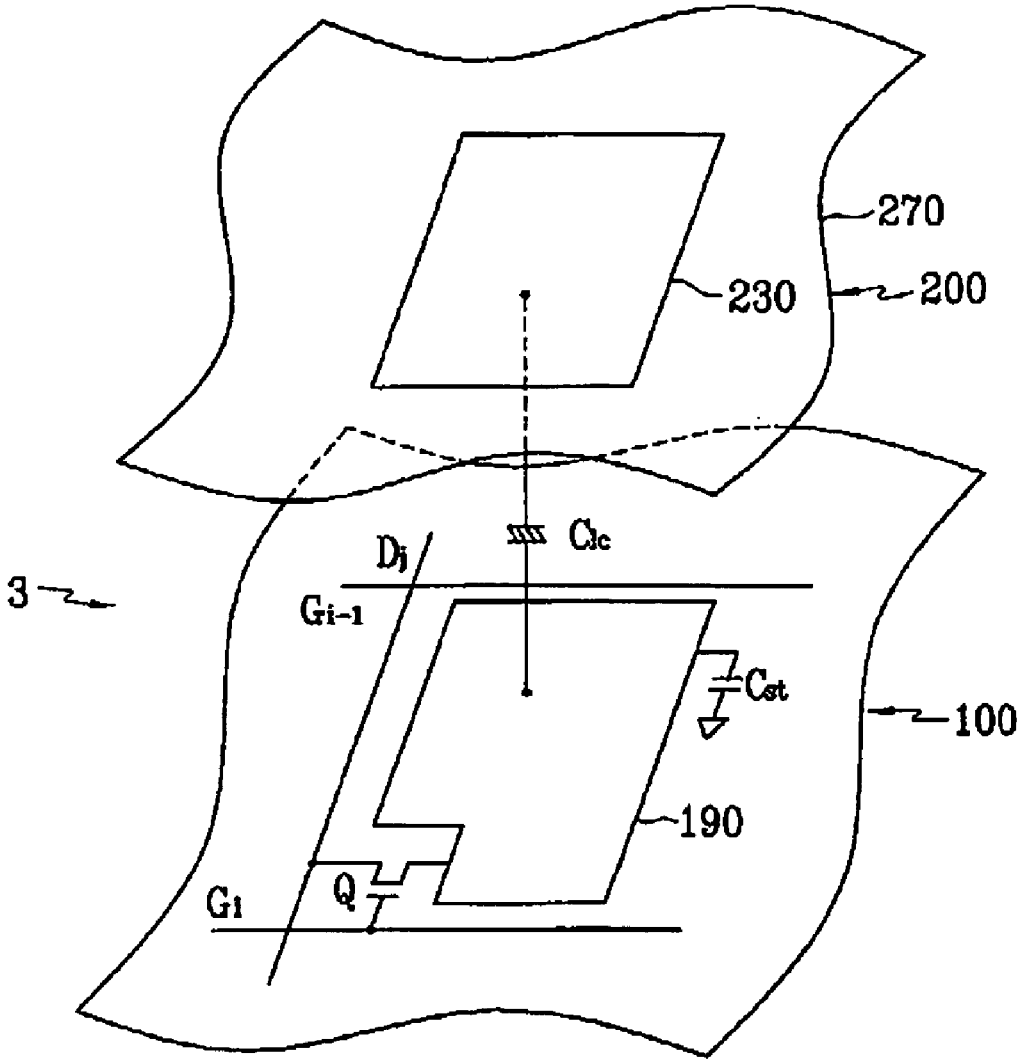
FIG. 6 is a diagram of a pixel in the LCD device of FIG. 5.

FIG. 5 is a block diagram of an LCD device according to an embodiment of the invention, and FIG. 6 is a diagram of a pixel in the LCD device of FIG. 5.

The LCD device of FIG. 5 includes an LC panel assembly 300 as well as a gate driver 400 and a data driver 500 that are connected to the LC panel assembly 300. A gray voltage generator is connected to the data driver 500. The gate driver 400 and the data driver 500 are controlled by the signal controller 600. The LC panel assembly 300 includes a plurality of display signal lines that define the pixels. The display signal lines includes gate lines $G_1$-Gn and data lines $D_1$-$D_m$. The pixels are arranged substantially in a matrix.

The gate lines $G_1$-Gn transmit gate signals (also referred to as "scanning signals") and the data lines $D_1$-$D_m$ transmit data signals. The gate lines $G_1$-Gn extend substantially parallel to one another. The data lines $D_1$-$D_m$ extend substantially parallel to one another and in a direction that is substantially perpendicular to the direction in which the gate lines $G_1$-Gn extend.

Each pixel includes a switching element Q connected to the signal lines $G_1$-Gn and $D_1$-$D_m$, an LC capacitor $C_{LC}$, and a storage capacitor $C_{ST}$. The LC capacitor $C_{LC}$ and the storage capacitor $C_{ST}$ are connected to the switching element Q. In some embodiments, the storage capacitor $C_{ST}$ may be omitted.

FIG. 6 shows that the switching element Q is provided on a lower panel 100 and has three terminals: a control terminal connected to one of the gate lines $G_1$-$G_n$, an input terminal connected to one of the data lines $D_1$-$D_m$, and an output terminal connected to both the LC capacitor $C_{LC}$ and the storage capacitor $C_{ST}$.

Figure 1:
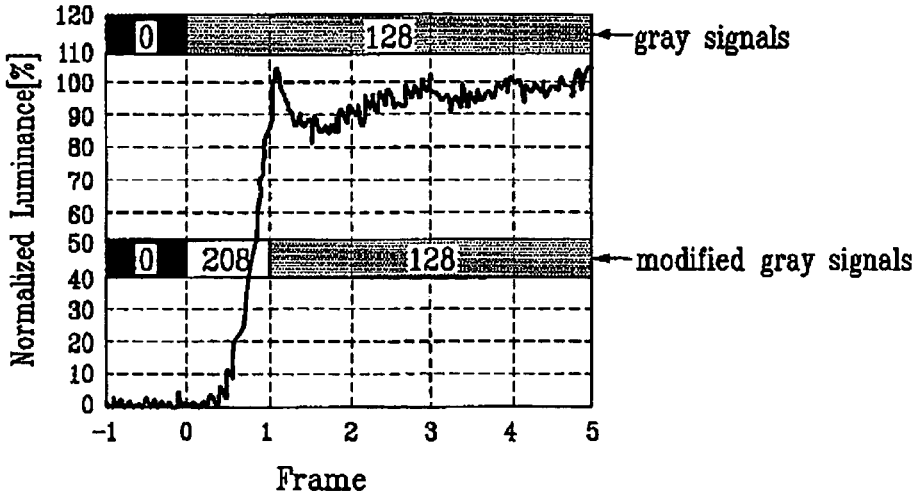
FIG. 1 (Prior Art)
FIG. 1 is a plot of the luminance level as a function of time in a conventional display device, wherein time is expressed as the number of frames.
Figure 2:
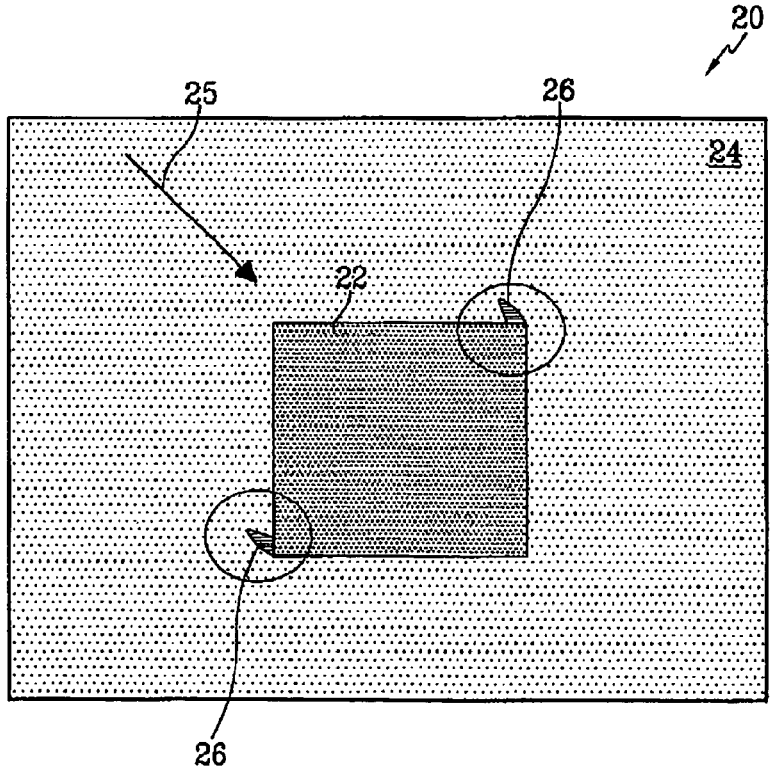
FIG. 2 (Prior Art)
FIG. 2 is a test screen used to check the performance of an LCD device.

The LC capacitor $C_{LC}$ includes a pixel electrode 190 provided on the lower panel 100 and a common electrode 270 provided on the upper panel 200 as two terminals. The LC layer 3 disposed between the two electrodes 190 and 270 functions as the dielectric material for the LC capacitor $C_{LC}$. The pixel electrode 190 is connected to the switching element Q, and the common electrode 270 is connected to the common voltage $V_{com}$ and covers the entire surface of the upper panel 200. Unlike FIG. 2, the common electrode 270 may be provided on the lower panel 100, and both electrodes 190 and 270 may have shapes of bars or stripes.

The storage capacitor $C_{ST}$ is an auxiliary capacitor for the LC capacitor $C_{LC}$. The storage capacitor $C_{ST}$ includes the pixel electrode 190 and a separate signal line (not shown) that is provided on the lower panel 100. The separate signal line overlies the pixel electrode 190 via an insulator, and is supplied with a predetermined voltage such as the common voltage $V_{com}$. Alternatively, the storage capacitor $C_{ST}$ includes the pixel electrode 190 and an adjacent gate line (e.g., a previous gate line) that overlies the pixel electrode 190 and sandwiches an insulating layer therebetween.

For a color display device, each pixel can represent a color by including one of red, green, and blue color filters 230. The color filter 230 is positioned over the pixel electrode 190. The color filter 230 shown in FIG. 6 is provided in an area of the upper panel 200. In alternative embodiments, the color filters 230 are positioned on or under the pixel electrode 190 and are part of the lower panel 100.

Although not shown, one or more polarizers are attached to at least one of the panels 100, 200.

Referring back to FIG. 5, the gray voltage generator 800 generates two sets of a plurality of gray voltages related to the transmittance of the pixels. The gray voltages in one set have a positive polarity with respect to the common voltage $V_{com}$, while the gray voltages in the other set have a negative polarity with respect to $V_{com}$.

The gate driver 400 is connected to the gate lines $G_1$-$G_n$ of the panel assembly 300 and synthesizes the gate-on voltage Von and the gate-off voltage $V_{off}$ from an external device to generate the gate signals for application to the gate lines $G_1$-$G_n$. The data driver 500 is connected to the data lines $D_1$-$D_m$ of the panel assembly 300 and applies data voltages, selected from the gray voltages supplied from the gray voltage generator 800, to the data lines $D_1$-$D_m$.

The signal controller 600 controls the gate driver 400 and the data driver 500. The signal controller 600 receives input image signals R, G, and B and input control signals controlling the display thereof such as a vertical synchronization signal Vsync, a horizontal synchronization signal Hsync, a main clock MCLK, and a data enable signal DE, from a graphics controller (not shown). After generating gate control signals CONT1 and data control signals CONT2 and processing the image signals R, G, and B suitable for the operation of the panel assembly 300 on the basis of the input control signals and the input image signals R, G, and B, the signal controller 600 provides the gate control signals CONT1 to the gate driver 400, and transmits the processed image signals R', G', and B' as well as the data control signals CONT2 to the data driver 500. At this time, the image type detector 620 of the signal controller 600 determines the type of the image, for example whether it is a still image or motion image, based on the difference in grays of the image data R, G, and B between a previous frame and the present frame. Thereafter, the signal controller 600 modifies the image data in accordance with the image type.

The gate control signals CONT1 include a vertical synchronization start signal STV for informing the start of a frame, a gate clock signal CPV for controlling the ouptut time of the gate-on voltage Von, and an output enable signal OE for defining the duration of the gate-on voltage Von.

The data control signals CONT2 include a horizontal synchronization start signal STH for informing the start of a horizontal period, a load signal LOAD for instructing to apply the data voltages to the data lines $D_1$-$D_m$, an inversion control signal RVS for reversing the polarity of the data voltages (with respect to the common voltage $V_{com}$), and a data clock signal HCLK.

The data driver 500 receives a packet of the image data R', G', and B' for a pixel row from the signal controller 600 and converts the image data R', G', and B' into analog data voltages selected from the gray voltages supplied from the gray voltage generator 800 in response to the data control signals CONT2 from the signal controller 600. Thereafter, the data driver 500 applies the data voltages to the data lines $D_1$-$D_m$.

In response to the gate control signals CONT1 from the signal controller 600, the gate driver 400 applies the gate-on voltage $V_{on}$ to the gate line $G_1$-$G_n$, thereby turning on the switching elements Q connected thereto. The data voltages applied to the data lines $D_1$-$D_m$ are supplied to the pixels through the activated switching elements Q.

The difference between the data voltage and the common voltage $V_{com}$ is represented as a voltage across the LC capacitor $C_{LC}$, which is sometimes referred to as the "pixel voltage." The LC molecules in the LC capacitor $C_{LC}$ have orientations depending on the magnitude of the pixel voltage, and the molecular orientations determine the polarization of light passing through the LC layer 3 (see FIG. 6). The polarizer(s) converts light polarization into a certain level of light transmittance.

During a frame, all gate lines $G_1$-$G_n$ are sequentially supplied with the gate-on voltage $V_{on}$ by repeating the above procedure by a unit of the horizontal period (which is indicated by 1H and equal to one period of the horizontal synchronization signal Hsync, the data enable signal DE, and a gate clock signal). Thus, thereby data voltages are applied to all pixels during a frame. Between frames, the inversion control signal RVS applied to the data driver 500 is controlled such that the polarity of the data voltages is reversed (which is called "frame inversion"). The inversion control signal RVS may be also controlled such that the polarity of the data voltages flowing in a data line in one frame are reversed (which is called "line inversion"), or the polarity of the data voltages in one packet are reversed (called "dot inversion").

Now, the operation of the gray signal converter of the invention will be described. The gray signal converter may be incorporated into the signal controller 600, although the invention is not so limited. The gray signal converter of the invention shortens the liquid crystal's response time and reduces the undesirable flickering effect. The gray signal converter of the invention uses the gray signal of the previous frame (herein referred to as the "previous gray signal" $g_{n-1}$), the gray signal of the current frame (herein referred to as the "current gray signal" $g_n$), and the expected gray signal of the next frame (herein referred to as the "next gray signal" $g_{n+1}$) to determine a modified current gray signal.

The gray signal converter of the invention compares the previous gray signal and the current gray signal. Based on the comparison, the next gray signal is classified into one of two groups. Depending on the classification, a modification factor is determined using the previous gray signal, the current gray signal, and the next gray signal. Then, the modification factor is used to determine the modified current gray signal.

For convenience, a gray signal is herein assumed to be an 8-bit signal. The most significant bit (MSB) is assumed to be an x-bit signal, and the least significant bit (LSB) is assumed to be a y-bit signal. With an 8-bit signal, $2^8$=256 gray levels may be expressed. With 256 gray levels that are possible in each frame, a total of 256×256=65,536 combinations are possible between the current gray signal $g_n$ and the next gray signal $g_{n+1}$. 65,536 is too large of a number of combinations to be custom-processed individually in a time-efficient manner. Thus, the invention pertains to a way of grouping the 65,536 possible combinations for efficient processing.

The possible combinations are divided into "blocks" according to the MSB of the current gray signal $g_n$ and the next gray signal $g_{n+1}$. Since the MSB has x number of bits, the combinations get divided into $2^x \times 2^x$ blocks. Imagining the blocks to be arranged in a matrix of rectangles, the location of the corners of the rectangles are then identified. First, the location of the corners are identified under the assumption that the LSB bits are 0. Then, a modification factor is determined based on the location of the corners. The modification factor may be determined during trial runs. Then, interpolation based on the corners' modification factor is used to determine a first preliminary modified signal $g'_1$ for areas between the corners. Preferably, all four corners are used to generate an accurate interpolation result. When only two or four corners are used, the interpolation may yield discontinuous results over the area of the rectangle.

The modification factors for each block are stored in a lookup table. The first preliminary modified signal $g'_1$ may be computed by accessing the modification factors from the lookup table.

The previous gray signal $g_{n-1}$ and the current gray signal $g_n$ are used to generate the second preliminary modified signal $g'_2$. The second preliminary modified signal $g'_2$ is generated in a manner similar to how the first preliminary modified signal $g'_1$ is generated. However, the second preliminary modified signal $g'_2$ may have a value that is different from that of the first preliminary modified signal $g'_1$ for the same block, and are stored in a separate lookup table than the lookup table that stores the first preliminary modified signal $g'_1$.

The invention entails classifying different combinations of gray levels over three frames into a predetermined number of classes based on the relative magnitudes of the gray levels. This way, once a gray signal is classified, the modified current gray signal that is applied to the current frame to achieve the optimal image quality can be determined in a time-efficient manner.

For example, the possible combinations may be classified into three different classes depending on which set of conditions are fulfilled. For combinations in the first class, the difference between the previous gray signal $g_{n-1}$ and the current gray signal $g_n$ is less than a first predetermined value $\alpha$, and the difference between the current gray signal $g_n$ and the next gray signal $g_{n+1}$ is greater than a second predetermined value $\beta$. For combinations in the second class, the difference between the previous gray signal $g_{n-1}$ and the current gray signal $g_n$ (also referred to as the first difference $\Delta_1$) exceeds the first predetermined value $\alpha$. For combinations in the third class, the difference between the previous gray signal $g_{n-1}$ and the current gray signal $g_n$ is less than $\alpha$, and the difference between the current gray signal $g_n$ and the next gray signal $g_{n+1}$ (also referred to as the second difference $\Delta_2$) is less than $\beta$.

The conditions for the three classes can equationally be summarized as follows:

The first class: $|g_{n-1}-g_n| \leqq \alpha$ and $|g_n-g_{n+1}|>\beta$

The second class: $|g_{n-1}-g_n|>\alpha$

The third class: $|g_{n-1}-g_n| \leqq \alpha$ and $|g_n-g_{n+1}| \leqq \beta$

The first and second predetermined values $\alpha$ and $\beta$ depend on the particular characteristics of the display devices. For a hypothetical display device whose predetermined values $\alpha$ and $\beta$ are both equal to 0, the three conditions for the classes are as follows:

The first class: $g_{n-1}=g_n \neq g_{n+1}$

The second class: $g_{n-1} \neq g_n$

The third class: $g_{n-1}=g=g_{n+1}$

EXAMPLE 1

A combination of three gray voltage levels is classified into the first class if the gray voltage level does not change much between the first frame and the second frame, but changes significantly between the second frame and the third frame. As used herein, the first frame is the previous frame, the second frame is the current frame, and the third frame is the next frame that will follow the current frame. A modification factor is determined according to the values of the current gray signal $g_n$ and the next gray signal $g_{n+1}$, and applied to the current frame. More specifically, a modified current gray signal that is applied to the current frame is determined anticipating the large change in the gray voltage level that is about to take place. Effectively, a part of the upcoming change in the gray voltage is applied to the current frame in what is herein referred to as "pre-shooting." In this case, the modified current gray signal is about equal to the preliminary modified signal $g'_1$. By pre-shooting, the gray level can be changed from the level of the current frame to the level of the next frame in a shorter period of time and the gray signal level of the next frame is stabilized sooner than the case where no pre-shooting is performed.

A combination of three gray voltage levels is classified into the second class if the gray voltage level change between the previous frame and the current frame is large. For a combination that falls into the second class, a modified current gray signal is determined based on the previous gray signal $g_{n-1}$ and the current gray signal $g_n$ and applied to the current frame. Effectively, the gray voltage level change that is about to occur between the current frame and the next frame is not taken into account in determining the modified current gray signal level for the current frame because the change between the previous frame and the current frame dominates it. The modified current gray signal, in this case, is about equal to the second preliminary modified signal $g'_2$.

A combination of three gray voltage levels is classified into the third class if the gray voltage level changes between three successive frames is small. In this case, no modification is applied to the current gray signal $g_n$. When the gray voltage level change is small, it is likely that the change is due to noise rather than a real change intended for the image. Applying a modified current gray signal for a case like this may lower, rather than improve, the image quality. Thus, no modification is performed.

EXAMPLE 2

This example illustrates an embodiment of the invention where a combination of three gray voltage levels are placed into one of five possible classes.

A combination is placed into the first class if the difference between the previous gray signal $g_{n-1}$ and the current gray signal $g_n$ is less than the first predetermined value (x and the next gray signal $g_{n+1}$ is greater than the current gray signal $g_n$.

In the second class, the previous gray signal $g_{n-1}$ is larger than the sum of the current gray signal $g_n$ and the first predetermined value $\alpha$, and the difference between the current gray signal $g_n$ and the next gray signal $g_{n+1}$ is greater than the second predetermined value $\beta$.

In the third class, the previous gray signal $g_{n-1}$ is greater than a sum of the current gray signal $g_n$ and the first predetermined value $\alpha$, and the difference between the current gray signal $g_n$ and the next gray signal $g_{n+1}$ is les than the second predetermined value $\beta$.

In the fourth class, the current gray signal $g_n$ is larger than the sum of the previous gray signal $g_{n-1}$ and the first predetermined value $\alpha$.

In the fifth class, the difference between the previous gray signal $g_{n-1}$ and the current gray signal $g_n$ is less than the first predetermined value $\alpha$, and the current gray signal $g_n$ is larger than the next gray signal $g_{n+1}$.

The first scenarios are equationally summarized as follows:

The first scenario: $|g_{n-1}-g_n| \leqq \alpha$ and $g_{n+1}>g_n$

The second scenario: $g_{n-1}-g_n>\alpha$ and $|g_n-g_{n+1}|>\beta$

The third scenario: $g_{n-1}-g_n>\alpha$ and $|g_n-g_{n+1}| \leqq \beta$

The fourth scenario: $g_n-g_{n-1}>\alpha$

The fifth scenario: $|g_{n-1}-g_n| \leqq \alpha$ and $g_{n+1} \leqq g_n$

As in Example 1 above, the values of $\alpha$ and $\beta$ depend on the particular characteristics of the display device.

The first class applies to a gray voltage level combination where the gray voltage level change between the previous frame and the current frame is small but that between the current frame and the next frame is large. In this case, the value of a modified current gray signal is determined based on the levels of the previous gray signal $g_{n-1}$, the current gray signal $g_n$, and the next gray signal $g_{n+1}$, and applied to the current frame. The modified current gray signal $g_n'$ is the largest of the first preliminary modified signal $g_1'$, the second preliminary modified signal $g_2'$, and the current gray signal level $g_n$. By taking $g_1'$, $g_2'$, and the level of the current gray signal $g_n$, an accurate pre-shooting can be performed.

The second class applies to a gray voltage level combination where there is a large gray voltage level drop between the previous frame and the current frame, and the voltage level changes significantly again between the current frame and the next frame. In this case, the modified current gray signal is determined based on the previous gray signal $g_{n-1}$ and the current gray signal $g_n$, and applied to the current frame. The modified current gray signal $g_n'$ is approximately equal to the smaller of the second preliminary modified current gray signal $g_2'$ and the current gray signal $g_n$. By modifying the current gray signal down, overshooting is avoided.

The third class applies to a gray voltage level combination where there is a large gray voltage level drop between the previous frame and the current frame, but no significant change in the gray voltage levels between the current frame and the next frame. The modified current gray signal $g_n'$ is determined based on the previous gray signal $g_{n-1}$ and the current gray signal $g_n$, and applied to the current frame. The modified current gray signal $g_n'$ is approximately the same as the second preliminary modified current gray signal $g_2'$.

The fourth scenario applies to a gray voltage level combination where there is a large increase in the gray voltage level between the previous frame and the current frame. In this case, the modified current gray signal $g_n'$ is determined based on the previous gray signal $g_{n-1}$ and the current gray signal $g_n$, and applied to the current frame. The modified current gray signal $g_n'$ is approximately the same as the second preliminary modified signal $g_2'$.

The fifth scenario applies to a gray voltage level combination where the gray voltage level changes between the previous frame and the current frame, and between the current frame and the next frame, are insignificant. In this case, no modified current gray signal $g_n'$ is applied.

Figure 7:
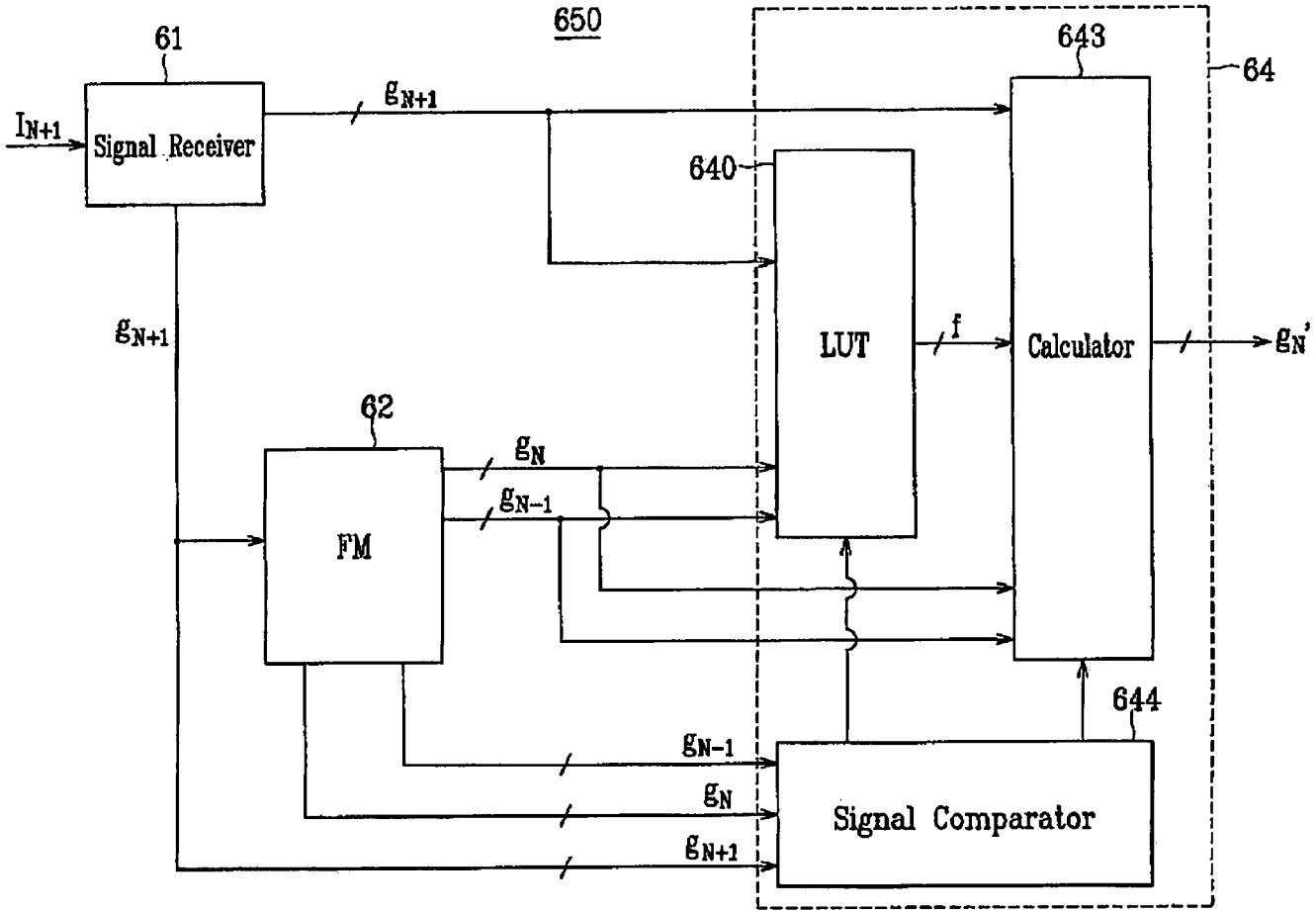
FIG. 7 is a block diagram of a first embodiment of the gray voltage modification module.
Figure 8:
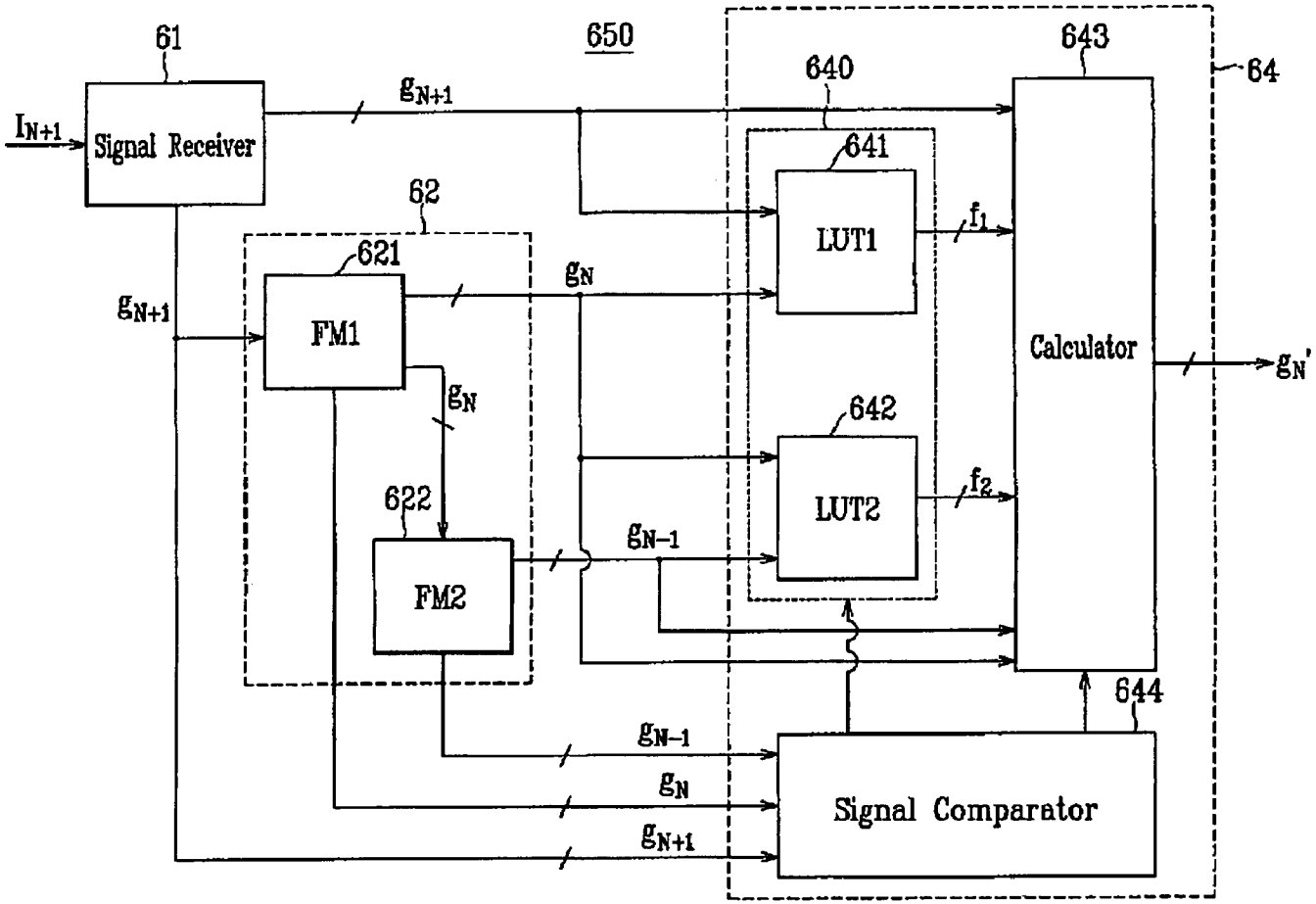
FIG. 8 is a block diagram of a second embodiment of the gray voltage modification module.
Figure 9:
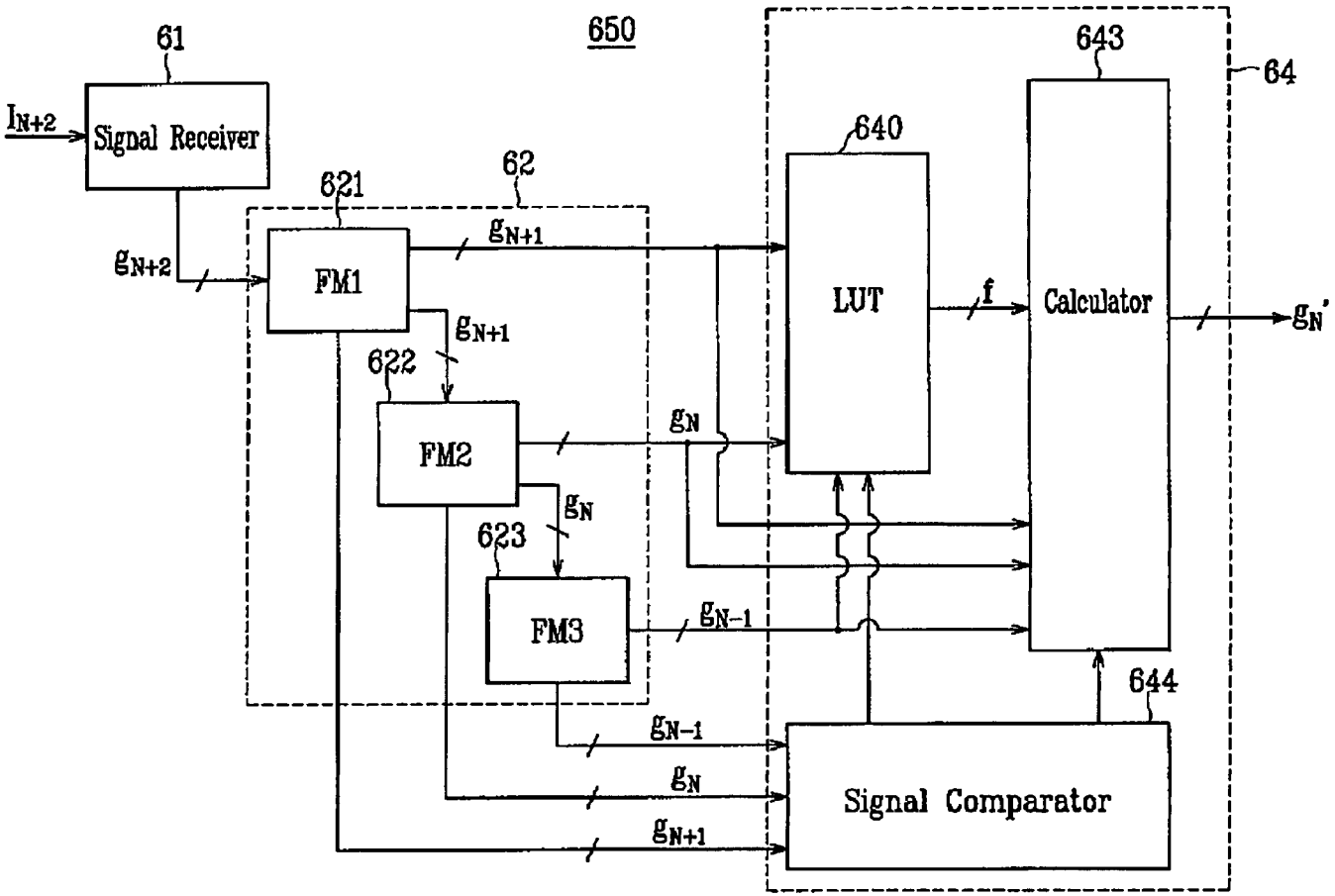
FIG. 9 is a block diagram of a third embodiment of the gray voltage modification module.

FIGS. 7, 8, and 9 illustrate some of the exemplary embodiments of the invention.

EXAMPLE 3

FIG. 7 is a block diagram of a first embodiment of the gray voltage modification module 650 for implementing the above-describe method. As shown in FIG. 7, the modification module 650 includes a signal receiver 61, a frame memory 62 coupled to the signal receiver 61, and a gray signal converter 64 that is coupled to both the signal receiver 61 and the frame memory 62.

The gray signal converter 64 includes a lookup table (LUT) 640, a calculator 643, and a signal comparator 644. The lookup table (LUT) 640 is coupled to the signal receiver 61 and the frame memory 62. More specifically, the input to the gray signal converter 64 is coupled to the lookup table 640, which receives input from the signal receiver 61 and the frame memory 62. The output of the gray signal converter 64 is coupled to a calculator 643.

The signal receiver 61 receives a raw input signal for the next frame ($I_{n+1}$) and converts it to a gray voltage signal that can be processed by the modification module 650. The signal receiver 61 distributes this converted version of the input signal $I_{n+1}$ to the frame memory 62 and the gray signal converter 64 as the next gray signal $g_{n+1}$.

The frame memory 62 stores the previous gray signal $g_{n-1}$ and the current gray signal $g_n$. In addition, the frame memory 62 receives the converted version of the next gray signal $g_{n+1}$ from the signal receiver 61 and stores it.

The signal comparator 644 receives the previous gray signal $g_{n-1}$ and the current gray signal $g_n$ from the frame memory 62 and compares the two signals to produce a comparison result. Then, based on which set of conditions the comparison result fulfills, a class is selected. The signal comparator 644 informs the lookup table 640 and the calculator 643 know which class is selected by sending signals.

The lookup table 640 has a total of $2^x \times 2^x$ blocks. In one of the blocks, a first modification factor $f_1$, which value is selected based on the current gray signal $g_n$ and the next gray signal $g_{n+1}$, is stored. In another block, a second modification factor $f_2$, which value is selected based on the previous gray signal $g_{n-1}$ and the current gray signal $g_n$, is stored. The first modification factor $f_1$ is useful for when the LSBs of the current gray signal $g_n$ and the next gray signal $g_{n+1}$ are 0. Similarly, the second modification factor $f_2$ is useful for when the LSBs of the previous gray signal $g_{n-1}$ and the current gray signal $g_n$ are 0. In FIG. 7, the first modification factor $f_1$ and the second modification factor $f_2$ are collectively shown as a modification factor f.

The class-identifying signal that the lookup table 640 receives from the signal comparator 644 indicates whether the lookup table 640 should provide the first modification factor $f_1$ or the second modification factor $f_2$ to the calculator 643. The lookup table uses this indication to retrieve the appropriate modification factor and forwards it to the calculator 643.

The calculator 643 uses the signal from the signal comparator 644, the gray signals received from the frame memory 62, and the modification factors received from the lookup table 640 to determine the modified current gray signal $g_n'$. In generating the modified current gray signal $g_n'$, the calculator 643 uses one or more of the first modification factor $f_1$, the second modification factor $f_2$, the previous gray signal $g_{n-1}$, the current gray signal $g_n$, and the next gray signal $g_{n+1}$. Using one or more of these factors, the calculator 643 generates the first preliminary modified signal $g_1'$ and the second preliminary modified signal $g_2'$. Then, using the first and the second preliminary modified signals $g_1'$ and $g_2'$, the calculator 643 generates the modified current gray signal $g_n'$. The modified current gray signal $g_n'$ is applied to the current frame to avoid overshooting and flickering.

EXAMPLE 4

FIG. 8 is a block diagram of a second embodiment of the gray voltage modification module 650. The second embodiment illustrates that the frame memory 620 and the lookup table 640 may each be implemented as multiple modules. The modification module 650 shown in FIG. 8 is similar to the modification module 650 shown in FIG. 7 except that the frame memory 62 is subdivided into a first frame memory section 621 and a second frame memory section 622 and the lookup table 640 is subdivided into a first sub-table 641 and a second sub-table 642.

As shown in FIG. 8, the first frame memory section 621 is coupled to, and receives input from, the signal receiver 61.

The second frame memory section 622 is coupled to the first frame memory section 621 such that the output of the first frame memory section 621 is an input to the second frame memory section 622.

In the embodiment shown, the first sub-table 641 and the second sub-table 642 are not directly connected to each other although the invention is not so limited. The first lookup table 641 receives signals from the signal receiver 61 and the first frame memory section 621, and outputs the first modification factor $f_1$ to the calculator 643. The second lookup table 642 receives signals from the first frame memory section 621 and the second frame memory section 622 and outputs the second modification factor $f_2$ to the calculator 643.

The first frame memory section 621 stores the current gray signal $g_n$ and, when prompted, provides the current gray signal $g_n$ to the gray signal converter 64 and the second frame memory section 622. The first frame memory section 621 also receives the next gray signal $g_{n+1}$ from the signal receiver 61 and stores it.

The second frame memory section 622 stores the previous gray signal $g_{n-1}$ and, when prompted, supplies the previous gray signal $g_{n-1}$ to the gray signal converter 64. The second frame memory also receives the current gray signal $g_n$ from the first frame memory section 621 and stores it.

The first sub-table 641 stores the first modification factor $f_1$, which is determined based on the current gray signal $g_n$ and the next gray signal $g_{n+1}$. The second sub-table 642 stores the second modification factor $f_2$, which is based on the previous gray signal $g_{n-1}$ and the current gray signal $g_n$. The first and the second sub-tables 641, 642 forward the first modification factor $f_1$ and/or the second modification factor $f_2$ to the calculator 643 in response to receiving a signal from the signal comparator 644. The signal from the signal comparator 644 indicates which modification factor to forward to the calculator 643.

EXAMPLE 5

FIG. 9 is a block diagram of a third embodiment of the gray voltage modification module 650. The third embodiment is similar to the first embodiment shown in FIG. 7, except the signal receiver 61 does not directly send the next gray signal $g_{n+1}$ information to the gray signal converter 64. In this third embodiment, the signal receiver 61 communicates with the signal converter 64 only through the frame memory 62. Although FIG. 9 shows the lookup table 640 as being one undivided unit, the lookup table 640 may be divided into subunits, as in Example 4 above.

In the third embodiment, the frame memory 62 includes a first frame memory section 621, a second frame memory section 622, and a third frame memory section 623 coupled in a cascade configuration. The first frame memory section 621 receives input from the signal receiver 61 and outputs a signal to the second frame memory section 622. The second frame memory section 622 receives the signal from the first frame memory section 621 and generates an output for the third frame memory section 623. The third frame memory section 623 receives the signal from the second frame memory section 622 and outputs a signal to the calculator 643. The first, second, and third frame memory sections 621, 622, 623 output the next gray signal $g_{n+1}$, the current gray signal $g_n$, and the previous gray signal $g_{n-1}$, respectively. Each of the first frame memory section 621 and the second frame memory section 622 is coupled to the lookup table 640 and the signal comparator 644. The third frame memory sections 623, however, is coupled to the calculator 643 and the signal comparator 644.

The first frame memory section 621 stores the next gray signal $g_{n+1}$ and provides the next gray signal $g_{n+1}$ to the second frame memory section 622 and the gray signal converter 64. The first frame memory section 621 receives a gray signal for the next frame from the signal receiver 61.

The second frame memory section 622 stores the current gray signal $g_n$ and provides it to the third frame memory section 623 and the gray signal converter 64. The second frame memory section 622 receives the next gray signal $g_{n+1}$ from the first frame memory section 621.

The third frame memory section 623 stores the previous gray signal $g_{n-1}$ and provides it to the gray signal converter 64. The third frame memory section 623 receives the current gray signal $g_n$ from the second frame memory section 622 and stores it.

As mentioned above, the gray modification module 650 may be incorporated into the signal converter 600 (see FIG. 5) or be implemented as a unit that is separate from the signal converter 600.

Figure 10:
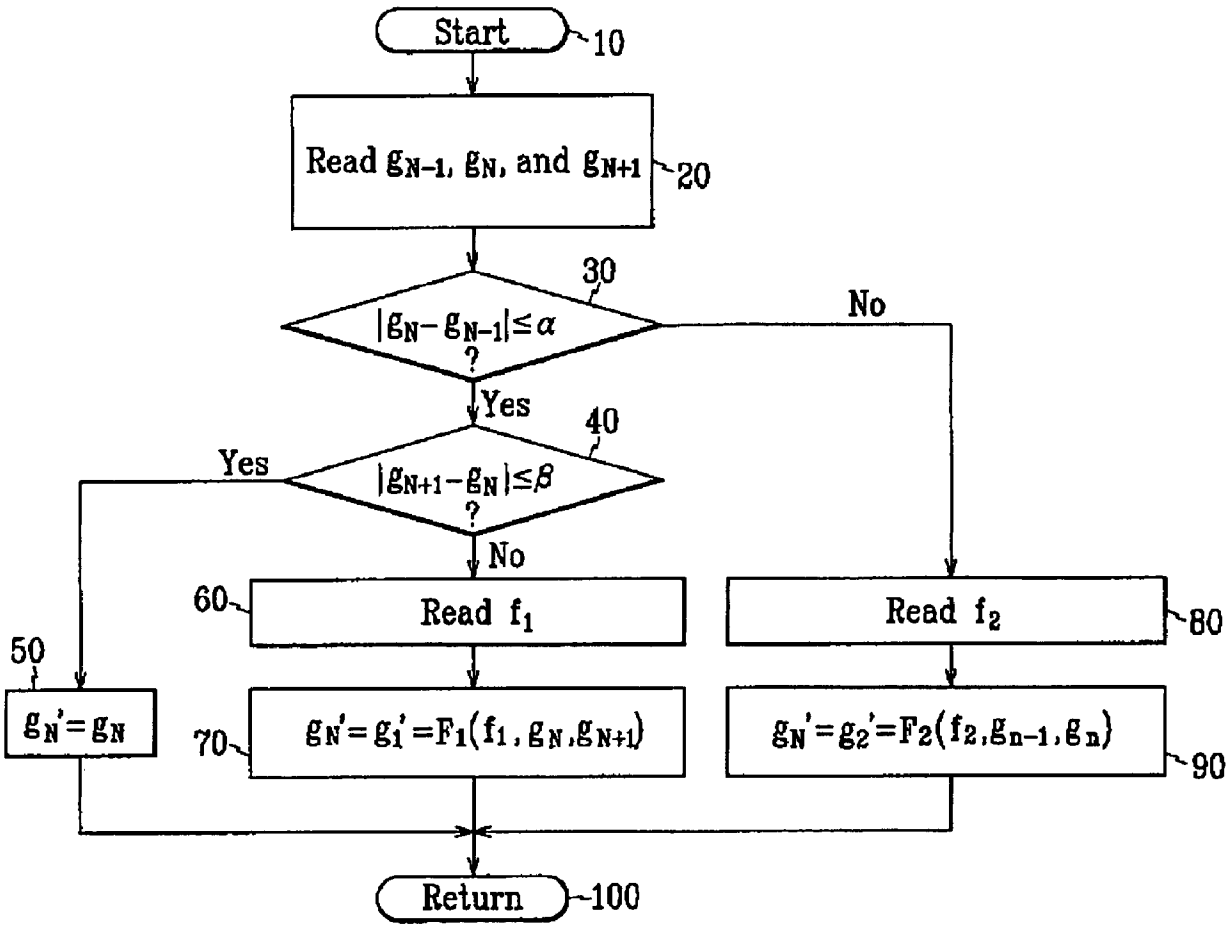
FIG. 10 is a flowchart illustrating an exemplary method in accordance with the invention.

FIG. 10 is a flowchart illustrating an exemplary method in accordance with the invention. At the start of the operation (step 10), the gray signal converter 64 reads the previous gray signal $g_{n-1}$ and the current gray signal $g_n$ (step 20). The signals may be received through the frame memory 62, as shown above in the exemplary embodiments. Then, the gray signal converter 64 determines a difference between the previous gray signal $g_{n-1}$ and the current gray signal $g_n$, and compares the difference to a first predetermined value $\alpha$ (step 30). The value of $\alpha$ is not necessarily constant and may be adjusted according to time-sensitive variables, such as signal values. Generally, when there is a lot of noise in the signals, $\alpha$ is set to a higher value than when noise is not a significant factor. The value of $\alpha$ is preferably selected from a range between 0 and the result of dividing the total number of gray levels by 16. Thus, for a display device that has a total of 256 gray levels, a would be a value between 0 and 16 (256/16=16).

If the difference calculated in step 30 is less than or equal to $\alpha$, the gray signal converter 64 moves on to step 40, where a difference between the next gray signal ($g_{n+1}$) and the current gray signal $g_n$ is compared to the second predetermined value $\beta$. The second predetermined value $\beta$ is determined in a manner similar to the first predetermined value $\alpha$, and may also be adjusted according to time-sensitive variables. If the difference calculated in step 40 is less than or equal to the second predetermined value $\beta$, the signal comparator 644 forwards the appropriate modified current gray signal $g_n'$ to the calculator 643. Since the comparison results in steps 30 and 40 indicate that the gray voltage levels do not change much between the previous frame, the current frame, and the next frame, the calculator 643 determines that no modification to the current gray signal is necessary. Thus, the calculator 643 sets the modified current gray signal $g_n'$ as the current gray signal $g_n$ (step 50).

If the difference calculated in step 40 turns out to be greater than the second predetermined value $\beta$, the signal comparator 644 outputs a indicator signal to the lookup table 640 and the calculator 643 indicating that the difference is greater than $\beta$. In response to this indicator signal, the calculator 643 receives the first modification value $f_1$ from the lookup table 640 (step 60), and determines the modified current gray signal $g_n'$ by using the first modification value $f_1$, the current gray signal $g_n$, and the next gray signal $g_{n+1}$ (step 70). Thus, the modified current gray signal $g_n'$ is a function of $f_1$, $g_n$, and $g_{n+1}$ ($g_n'=g_1'=F1(f_1, g_n, g_{n+1})$) where the gray voltage level does not change much between the previous and the current frames but changes more significantly between the current frame and the next frame.

If the difference calculated in step 30 is greater than $\alpha$, the indicator signal output by the signal comparator 644 indicates to the lookup table 640 and the calculator 643 that $\alpha$ is less than the difference. In response, the calculator 643 retrieves the second modification factor $f_2$ from the lookup table 650 (step 80) and determines a second preliminary modified signal $g_2'$. The second preliminary modified signal $g_2'$ is a function of the second modification factor $f_2$, the previous gray signal $g_{n-1}$ and the current gray signal $g_n$ (step 90). Thus, where the difference calculated in step 30 is greater than $\alpha$, indicating that the gray voltage levels changed significantly between the previous frame and the current frame, the modified current gray signal $g_n'$ is $g_n'=g_2'=F2\ (f_2, g_{n-1}, g_n)$.

Figure 11:
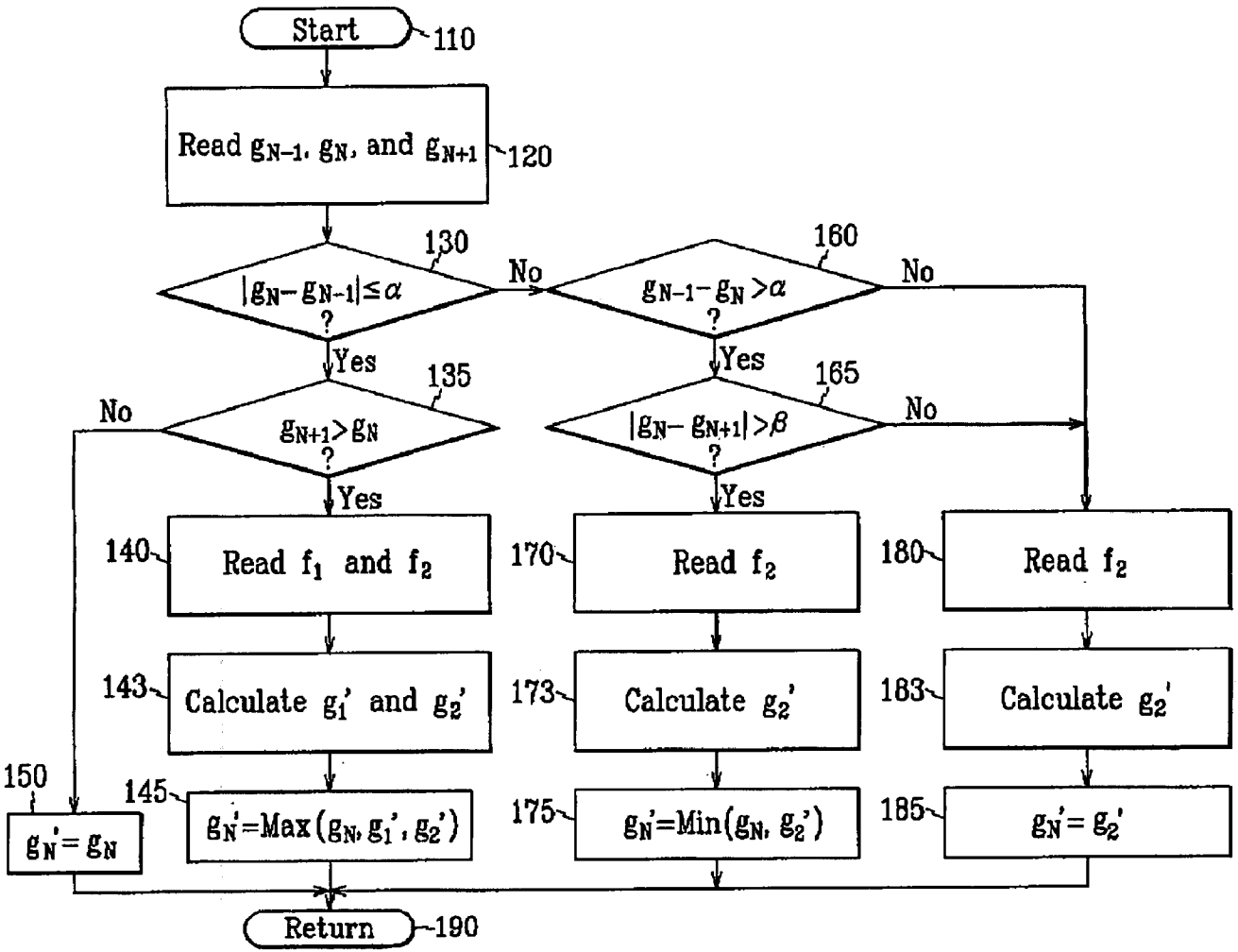
FIG. 11 is a flowchart illustrating another exemplary method in accordance with the invention.

FIG. 11 is a flowchart illustrating another exemplary method in accordance with the invention. Upon starting (step 110), the gray signal converter 64 receives the previous gray signal $g_{n-1}$, the current gray signal $g_n$, and the next gray signal $g_{n+1}$ from the signal receiver 61 (step 120). Then, the signal comparator 644 compares the difference between the previous gray signal $g_{n-1}$ and the current gray signal $g_n$ to the first predetermined value $\alpha$ (step 130). If the difference calculated in step 130 is less than or equal to $\alpha$, the signal comparator 644 proceeds to compare the current gray signal $g_n$ to the next gray signal $g_{n+1}$ (step 135). If the next gray signal $g_{n+1}$ is greater than the current gray signal $g_n$, the signal comparator 644 sends a indicator signal to the lookup table 640 and the calculator 643 indicating this comparison result.

Reading the indicator signal, the calculator 643 retrieves the first and the second modification factors $f_1$, $f_2$ from the lookup table 640 (step 140). Then, the calculator 643 dompites the first preliminary modified signal $g_1'$ using the first modification factor $f_1$, the current gray signal $g_n$, and the next gray signal $g_{n+1}$ (step 143). Similarly, the calculator 643 also computes the second preliminary modified signal $g_2'$ by using the second modification factor $f_2$, the previous gray signal $g_{n-1}$, and the current gray signal $g_n$ (step 143). Ultimately, the modified current gray signal $g_n'$ is determined to be the greatest of the first preliminary modified signal $g_1'$, the second preliminary modified signal $g_2'$, and the current gray signal $g_n$ (step 145).

If, in step 135, the signal comparator 644 indicates that the current gray signal $g_n$ is greater than or equal to the next gray signal $g_{n+1}$, the signal comparator 644 transmits an indicator signal to the calculator 643 to indicate this comparison result. Upon receiving the indicator signal, the calculator 643 uses the current gray signal $g_n$ without modification (step 150).

If, in step 130, it is determined that the difference between the previous gray signal $g_{n-1}$ and the current gray signal $g_n$ is larger than the first predetermined value $\alpha$, the signal comparator 644 then compares the difference between the previous gray signal $g_{n-1}$ and the current gray signal $g_n$ to the predetermined value $\alpha$ (step 160). If the difference exceeds the first predetermined value $\alpha$, then the difference between the current gray signal $g_n$ and the next gray signal $g_{n+1}$ is determined and compared to the second predetermined value $\beta$ (step 165). If the difference calculated in step 165 exceeds the second predetermined value $\beta$, the signal comparator 644 sends this comparison result to the calculator 643 in the form of an indicator signal.

In response to the indicator signal, the calculator 643 retrieves the second modification factor $f_2$ from the lookup table 640 (step 170) and computes the second preliminary modified signal $g_2'$ using the second modification factor $f_2$ and the previous gray signal $g_{n-1}$. Then, the calculator 643 selects the smaller of the second preliminary modified signal $g_2'$ and the current gray signal $g_n$ and uses it as the modified current gray signal $g_n$ (step 175).

If it is determined in step 165 that the difference is less than the second predetermined value $\beta$, or if it is determined in step 160 that the difference is less than the first predetermined value $\alpha$, the signal comparator 644 retrieves a value from the lookup table 640 that reflects these conditions and transmits it to the calculator 643 as a signal. Upon receiving the signal, the calculator 643 retrieves the second modification factor $f_2$ from the lookup table 640 (step 180). Then, using the second modification factor $f_2$, the previous gray signal $g_{n-1}$, and the current gray signal $g_n$, the calculator 643 determines the second preliminary modified signal $g_2'$ (step 183). The second preliminary modified signal $g_2'$ is then used as the modified current gray signal $g_n'$ for the current frame.

Figure 12:
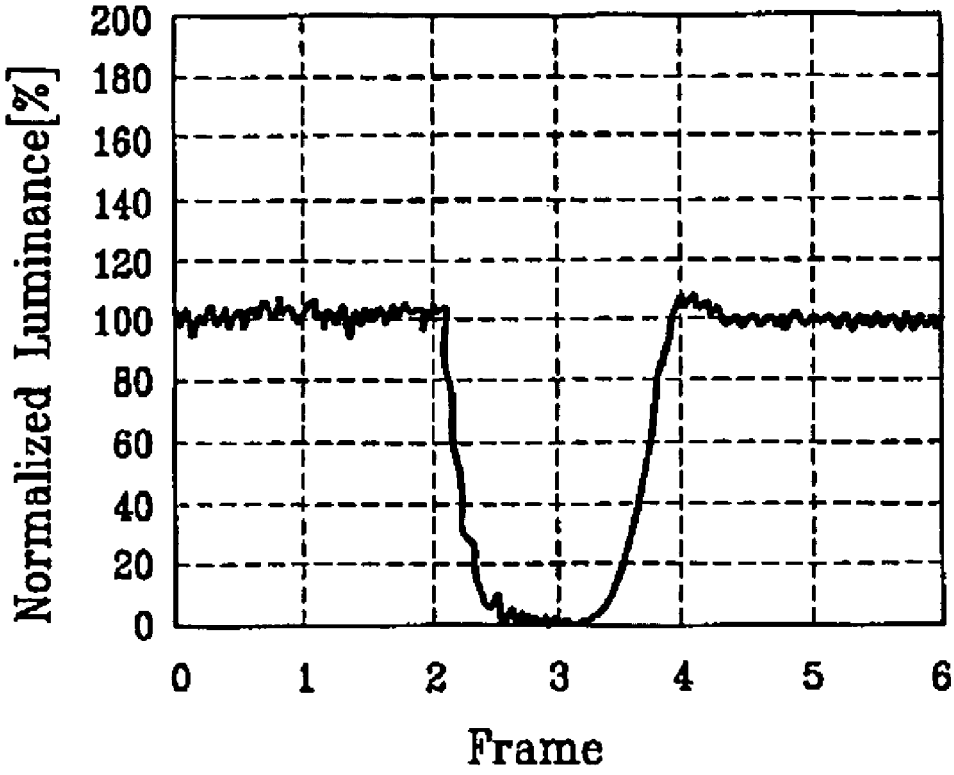
FIG. 12 a plot illustrating the luminance as a function of time for a display device implemented according to the invention.

FIG. 12 a plot illustrating the luminance as a function of time for a display device implemented according to the invention. More specifically, the plot of FIG. 12 is the result of applying the test described above in reference to FIG. 2 to the display device of the invention.

Figure 3:
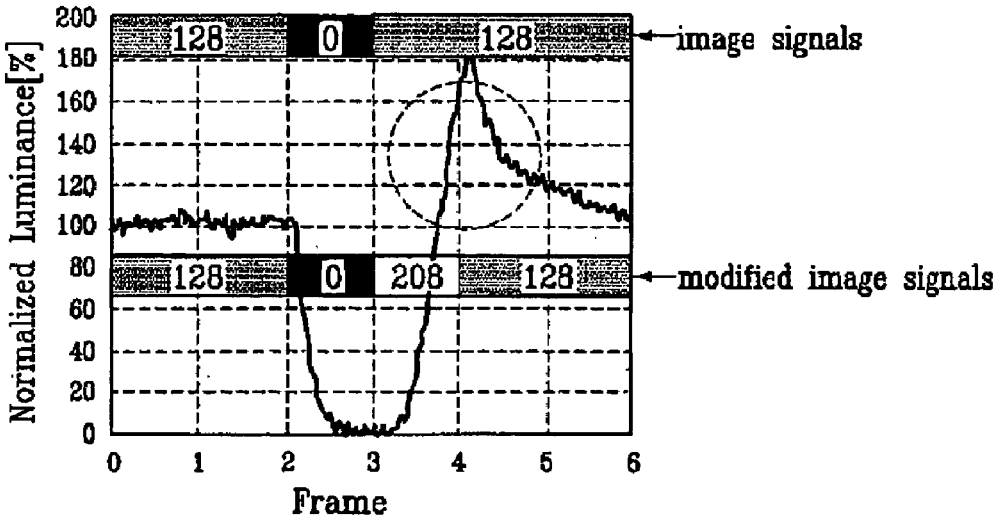
FIG. 3(Prior Art)
FIG. 3 is a plot of luminance level as a function of time as applied to the test shown in FIG. 2.
Figure 4A:
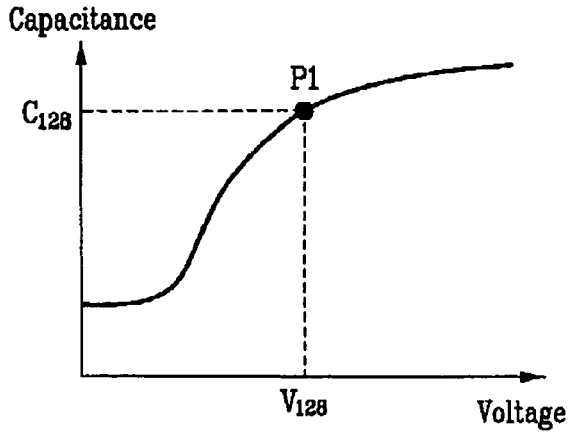
FIG. 4A(Prior Art)
FIGS. 4A, 4B, and 4C are plots showing liquid crystal capacitance as a function of voltage for a conventional display device.
Figure 4B:
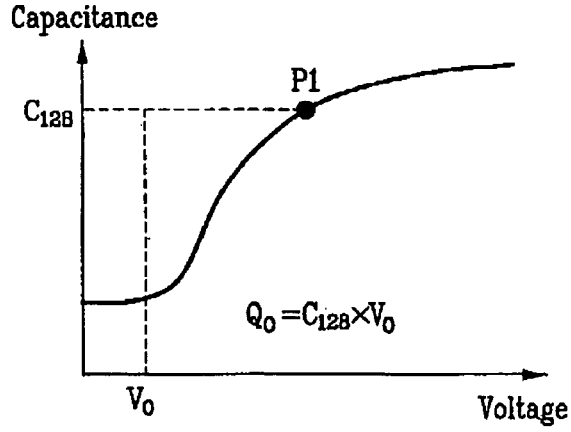
FIG. 4B(Prior Art)
Figure 4C:
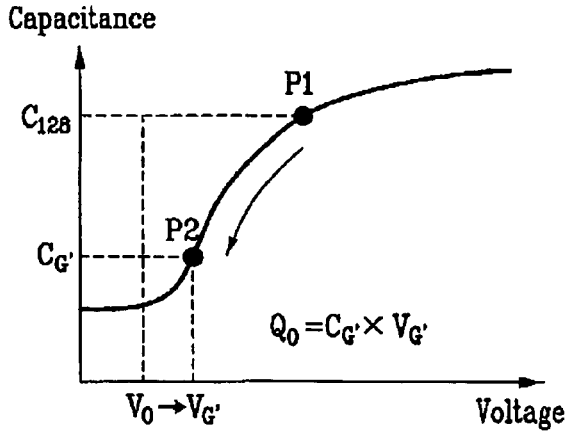
FIG. 4C(Prior Art)

When compared with the plot of FIG. 3, which shows the result of the same test for a conventional display device, it can be seen that the degree of overshooting at frame 4 is substantially reduced, and almost eliminated, by implementing the invention. Also, with the display device of the invention, there is no unstable phase following the overshooting because there is substantially no overshooting. The result of this significant reduction in overshooting is that the undesirable cyan artifacts of FIG. 2 no longer exist.

Furthermore, the invention helps reduce the flicker phenomenon by using the first modification factor $f_1$ and the second modification factor $f_2$ for different gray levels.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A method of driving a display device, the method comprising:

determining a first difference $\Delta_1$, wherein $\Delta_1$ is a difference between gray signals of two consecutive frames;

comparing $\Delta_1$ to a predetermined value to obtain a comparison result;

using the comparison result to determine a modified current gray signal; and, applying the modified current gray signal to a current frame;

wherein the gray signals are a current gray signal for the current frame and a previous gray signal for a frame preceding the current frame;

wherein the predetermined value is a first predetermined value and the comparison result is a first comparison result, and further comprising:

determining a second difference $\Delta_2$, wherein $\Delta_2$ is a difference between the current gray signal and a next gray signal for a frame succeeding the current frame;

comparing $\Delta_2$ to a second predetermined value to obtain a second comparison result; and, using the second comparison result to determine the modified current gray signal.

2. The method of claim 1, wherein using the comparison result to determine a modified current gray signal comprises:

retrieving a modification factor from a lookup table, wherein the modification factor is selected based on the comparison result;

calculating a preliminary modified signal with a calculator by using the modification factor; and, using the preliminary modified signal to determine a modified current gray signal.

3. The method of claim 2, wherein the comparison result is one of a plurality of predetermined comparison results, each of which is associated with a modification factor.

4. The method of claim 3, wherein the modified current gray signal is equal to one of the preliminary modified signal and the gray signals of the two consecutive frames.

5. The method of claim 1, further comprising making the modified current gray signal equal to the current gray signal if $\Delta_1$ is less than or equal to the first pre-determined value and $\Delta_2$ is less than or equal to the second predetermined value.

6. The method of claim 1, further comprising:

determining a first modification factor based on a value of $\Delta_1$;

determining a second modification factor based on a value of $\Delta_2$; and, using one or both of the first and the second modification factors to determine the modified current gray signal.

7. The method of claim 1, further comprising making the modified current gray signal equal to the current gray signal if $\Delta_1$ is less than or equal to the predetermined value.

8. The method of claim 1, further comprising:

checking a relative magnitudes of the gray signals; and, adjusting the modified current gray signal according to the relative magnitudes.

9. The method of claim 8, further comprising:

retrieving a plurality of preliminary modified signals from a lookup table, wherein the preliminary modified signals are selected based on the comparison result; and, making the modified current gray signal equal to the largest among the current gray signal and the plurality of modified current gray signals.

10. An apparatus for driving a display device, the apparatus comprising:

a signal receiver for producing gray signals in a predefined format;

a frame memory configured to receive the gray signals, the frame memory storing gray signal levels;

a gray signal converter configured to receive the gray signals from the frame memory, wherein the gray signal converter includes:

a lookup table that stores modification factors;

a signal comparator that compares the different gray signal levels and selects a modification factor from the modification factors stored in the lookup table; and, a calculator that computes a modified current gray signal to be applied to a current frame by using the selected modification factor, wherein the lookup table comprises:

a first sub-table that stores a first modification factor that is determined based on the current gray signal and a next gray signal; and, a second sub-table that stores a second modification factor that is determined based on the current gray signal and a previous gray signal.

11. The apparatus of claim 10, wherein the frame memory comprises:

a first frame memory section that stores a current gray signal for the current frame; and, a second frame memory section that stores a previous gray signal for a frame preceding the current frame, such that the signal comparator receives the current gray signal from the first frame memory section, the previous gray signal from the second frame memory section, and a next gray signal from the signal receiver, wherein the next gray signal is a gray signal for a frame succeeding the current frame.

12. The apparatus of claim 11, wherein the first sub-table receives signals from the signal receiver and the first frame memory section, and the second sub-table receives signals from the first frame memory section and the second frame memory section.

13. The apparatus of claim 10, wherein the frame memory comprises:

a first frame memory section that stores a next gray signal for a frame succeeding the current frame;

a second frame memory section that stores a current gray signal for the current frame; and, a third frame memory section that stores a previous gray signal for a frame preceding the current frame, such that the signal comparator receives the next gray signal from the first frame section, the current gray signal from the second frame memory section, and the previous gray signal from the third frame memory section.

14. The apparatus of claim 13, wherein the signal receiver is coupled to the gray signal converter only through the frame memory.

15. The apparatus of claim 13, wherein the first frame memory section and the second frame memory section send signals to the lookup table and the third frame section sends signals to the calculator.

16. The apparatus of claim 10, wherein the lookup table forwards the modification factor directly to the calculator.

17. A display device, comprising:

a display panel having pixels defined by gate lines and data lines;

a driving apparatus for providing signals to the gate lines and the data lines, wherein the driving apparatus includes:

a frame memory configured to receive gray signals, the frame memory storing gray signal levels for a plurality of frames;

a lookup table coupled to the frame memory, wherein the lookup table stores modification factors;

a signal comparator that compares the gray signal from the frame memory and selects a modification factor from the modification factors stored in the lookup table based on the comparison; and, a calculator that receives the modification factor and determines a modified current gray signal to be applied to a current frame by using the selected modification factor, wherein the lookup table comprises:

a first sub-table that stores a first modification factor that is determined based on the current gray signal and a next gray signal; and, a second sub-table that stores a second modification factor that is determined based on the current gray signal and a previous gray signal.

18. A method of driving a display device, the method comprising:

determining a first gray signal level for a first frame;

determining a second gray signal level for a second frame that follows the first frame;

determining a third gray signal level for a third frame that follows the second frame; and, determining a modified signal level to apply to the second frame based on relative magnitudes of the first gray signal level, the second gray signal level, and the third gray signal level.

19. The method of claim 18, wherein a modification factor is used to compute the modified voltage level, further comprising:

classifying the second frame into one of a predetermined set of classes based on the relative magnitudes of the first gray signal level, the second gray signal level, and the third gray signal level; and, selecting the modification factor based on the classification.

20. The method of claim 18, wherein the relative magnitudes of the first gray signal level, the second gray signal level, and the third gray signal level comprise a first difference $\Delta_1$ between the first gray signal level and the second gray signal level, and a second difference $\Delta_2$ between the second gray signal level and the third gray signal level.

21. The method of claim 20, wherein the modified signal level is determined based on:

(a) the first and the second gray signal levels when the first difference $\Delta_1$ is larger than a first predetermined value; and, (b) the second and the third gray signal levels when the first difference $\Delta_1$ is equal to or smaller than the first predetermined value and the second difference $\Delta_2$ is larger than a second predetermined value, and, the modified signal level is determined to be equal to the second gray signal level when the first difference $\Delta_1$ is equal to or smaller than the first predetermined value and the second difference $\Delta_2$ is equal to or smaller than the second predetermined value.

22. The method of claim 20, wherein the modified signal level is determined based on:

(a) the first, the second, and the third gray signal levels when the first difference $\Delta_1$ is equal to or smaller than a first predetermined value and the third gray signal level is larger than the second gray signal level; and, (b) the first and the second gray signal levels when the first difference $\Delta_1$ is larger than the first predetermined value, and, the modified signal level is determined to be equal to the second signal level when the first difference $\Delta_1$ is equal to or smaller than a first predetermined value and the third gray signal level is equal to or smaller than the second gray signal level.

23. The method of claim 22, wherein the modified signal level is determined to be equal to:

(c) the smaller of the second gray signal level and a first preliminary signal level that is determined depending on the first and the second signal levels when the first signal level is larger than a sum of the second signal level and the first predetermined value and the second difference $\Delta_2$ is larger than the second predetermined value; and, (d) the first preliminary signal level when the first signal level is larger than the sum of the second signal level and the first predetermined value and the second difference $\Delta_2$ is equal to or smaller than the second predetermined value; and, (e) the first preliminary signal level when the first signal level is smaller than the sum of the second signal level and the first predetermined value.

24. The method of claim 23, wherein the modified signal level is determined to be equal to the largest of the second signal level, the first predetermined signal level, and a second predetermined signal level that that is determined depending on the second and the third signal levels.

* * * * *